US007112738B2

(12) United States Patent
Hyakutake et al.

(10) Patent No.: US 7,112,738 B2
(45) Date of Patent: Sep. 26, 2006

(54) ELECTRONIC MUSICAL INSTRUMENT

(75) Inventors: Seiichi Hyakutake, Hamamatsu (JP); Junichi Mishima, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 95 days.

(21) Appl. No.: 10/781,206

(22) Filed: Feb. 17, 2004

(65) Prior Publication Data

US 2004/0163529 A1 Aug. 26, 2004

(30) Foreign Application Priority Data

Feb. 17, 2003 (JP) ..... 2003-038914

(51) Int. Cl.
*G10H 1/02* (2006.01)

(52) U.S. Cl. ..... 84/737; 84/654; 84/646; 84/723

(58) Field of Classification Search ..... 84/737, 84/740, 739, 1, 731, 654, 646, 723
See application file for complete search history.

(56) References Cited

U.S. PATENT DOCUMENTS 3,555,166 A * 1/1971 Gasser ..... 84/600
3,742,114 A * 6/1973 Barkan ..... 84/740
4,372,187 A * 2/1983 Berg ..... 84/722
4,951,545 A * 8/1990 Yoshida ..... 84/646
5,024,134 A * 6/1991 Uchiyama ..... 84/654
5,085,120 A * 2/1992 Ishiguro ..... 84/737
5,717,155 A * 2/1998 Szalay ..... 84/723
6,111,179 A * 8/2000 Miller ..... 84/442

FOREIGN PATENT DOCUMENTS

JP 2002-196752 7/2002
JP 2002-215158 7/2002

* cited by examiner

*Primary Examiner*—Jeffrey Donels
*Assistant Examiner*—Christina Russell
(74) *Attorney, Agent, or Firm*—Morrison & Foerster LLP

(57) ABSTRACT

An electronic musical instrument which can realize a choking effect by a simple operation. The electronic musical instrument is constructed such that a neck provided with a fingerboard is fixed to a body. A plurality of (twelve) fret operating elements are provided for each of six sounding channels. The body is provided with a string input section and an arm, and six stringed operating elements are provided for the respective sounding channels. For each sounding channel, a tone generator generates a musical tone at a pitch determined by the corresponding fret operating element and in sounding timing determined by the corresponding stringed operating element. When the arm is operated, a CPU provides control to apply a choking effect to a musical tone for a sounding channel, in which the musical tone is being sounded, by raising the pitch of the musical tone by a predetermined amount.

21 Claims, 9 Drawing Sheets

ELECTRONIC MUSICAL INSTRUMENT

BACKGROUND OF THE INVENTION

1. Field of the Invention

The present invention relates to an electronic musical instrument such as a string instrument, which designates the pitch using switches such as depression type switches provided on a fingerboard, and determines sounding timing according to operations of operating elements such as artificial strings to electrically generate musical tones.

2. Description of the Related Art

As disclosed in Japanese Laid-Open Patent Publication (Kokai) No. 2002-196752, an electronic musical instrument has been known which is configured like a guitar, for example, and electrically generates musical tones according to operation of a plurality of operating switches (first prior art). This electronic musical instrument has a plurality of depression type operating switches arranged on a fingerboard at the neck and at locations corresponding to areas between frets of a guitar, designates the pitch according to operations of the operating switches, and detects a plucking operation of a plurality of lines (string members) provided at the body to generate musical tones in response to detection signals as trigger signals indicative of the detected plucking operations. This artificially realizes guitar performance.

The electronic musical instrument according to the first prior art, however, can only designate the pitch and the sounding timing and hence can generate monotonous musical tones. To address this problem, an electronic musical instrument has been proposed as disclosed in Japanese Laid-Open Patent Publication No. 2002-215158, which is provided with arm type operating elements like tremolo arms of an electronic guitar or the like, for providing electric control to realize a musical tone effect (vibrato)(second prior art).

The electronic musical instrument according to the second prior art, however, can only provide a vibrato effect for all strings as a musical tone effect, but cannot provide a choking effect representative for live guitar performance, and hence there is still room for improvement of the electronic musical instrument in terms of expressiveness in performance.

SUMMARY OF THE INVENTION

It is therefore an object of the present invention to provide an electronic musical instrument which can realize a choking effect by a simple operation.

To attain the above object, in a first aspect of the present invention, there is provided an electronic musical instrument comprising a musical instrument body, a fingerboard fixed to the musical instrument body, a plurality of pitch designation operating elements provided on the fingerboard in a manner being capable of being depressed, wherein pitch of musical tones to be generated in each of a plurality of sounding channels is designated according to whether at least one corresponding pitch designation operation element of the pitch designation operating elements has been depressed, a plurality of timing determination operating elements provided on the musical instrument body, for determining sounding timing for respective ones of the sounding channels, a musical tone generator that generates musical tones according to operation of the pitch designation operating elements and operation of the timing determination operating elements, an effect-application operating element provided on the musical instrument body in a vicinity of the timing determination operating elements, and a controller responsive to operation of the effect-application operating element, for providing control to obtain a choking effect by raising the pitch of a musical tone being generated by a predetermined amount for a channel among all the sounding channels, for which the pitch has been designated by depression of one of the pitch designation operating elements and in which the musical tone is being generated by the musical tone generator.

According to the first aspect of the present invention, the pitch of musical tones to be generated can be controlled to be varied for each channel, so that the choking effect is realized by a simple operation.

To attain the above object, in a second aspect of the present invention, there is provided an electronic musical instrument comprising a musical instrument body, a fingerboard fixed to the musical instrument body, a plurality of pitch designation operating elements provided on the fingerboard, for determining pitch of musical tones to be generated, at least one timing determination operating element provided on the musical instrument body, for determining sounding timing, a musical tone generator that generates musical tones according to operation of the pitch designation operating elements and operation of the timing determination operating element, an effect-application operating element provided on the musical instrument body in a vicinity of the timing determination operating element, and a controller responsive to operation of the effect-application operating element, for providing control to obtain a choking effect by raising the pitch of a musical tone being generated by the musical tone generator by a predetermined amount, the controller providing control to vary the pitch of the musical tone during choking according to an operating manner of the effect-application operating element.

According to the second aspect of the present invention, a variation in pitch of musical tones to be generated is controlled, so that various choking effects are realized by simple operations.

To attain the above object, in a third aspect of the present invention, there is provided an electronic musical instrument comprising a base, a fingerboard fixed to the base, a plurality of pitch designation operating elements provided on the fingerboard, for designating pitch of musical tones to be generated, at least one timing determination operating element provided on the base, for controlling sounding timing, a musical tone generator that generates musical tones according to operation of the pitch designation operating elements and operation of the timing determination operating element, an arm disposed in a vicinity of the timing determination operating element in a manner being capable of being operated, and an auto-choking controller that provides control to gradually raise the pitch of a musical tone being generated by the musical tone generator during operation of the arm after the operation of the arm is started.

According to the third aspect of the present invention, the choking effect can be realized by a simple operation.

To attain the above object, in a fourth aspect of the present invention, there is provided an electronic musical instrument comprising a base, a fingerboard supported by the base, a plurality of pitch designation operating elements provided on the fingerboard, for designating pitch of musical tones to be generated, at least one timing determination operating element provided on the base, for controlling sounding timing, a musical tone generator that generates musical tones according to operation of the pitch designation operating elements and operation of the timing determination operating element, an arm disposed in a vicinity of the timing determination operating element in a manner being capable of being operated in a predetermined direction and in a direction opposite to the predetermined direction, and an auto-choking controller operable when the arm is operated in the predetermined direction while the musical tone generator is generating a musical tone, to provide control to issue a choking-on instruction to start a choking function, and to gradually raise the pitch of the musical tone during operation of the arm, the auto-choking controller being operable when the arm is operated in the direction opposite to the predetermined direction during execution of the choking function, to provide control to issue a choking-off instruction to turn off the choking function, and to return the pitch of the musical tone being generated by the musical tone generator to an original sounding pitch designated by the pitch designation operating elements before the choking function is started.

According to the fourth aspect of the present invention, the choking effect can be realized by a simple operation.

Preferably, in the electronic musical instrument according to the second aspect of the present invention, the effect-application operating element is operatable in a plurality of stages, and the controller is responsive to operation of the effect-application operating element, for providing control to vary the pitch of the musical tone during choking according to a stage, out of the plurality of stages, in which the effect-application operating element is operated.

Preferably, in the electronic musical instrument according to the third aspect of the present invention, the arm is operatable in a plurality of stages, and the auto-choking controller provides control to raise the pitch of a musical tone being generated by the musical tone generator according to a stage, out of the plurality of stages, in which the arm is operated.

Preferably, the electronic musical instrument according to any of the first to fourth aspects of the present invention further comprises a parameter setting operating element for setting a highest pitch of a musical tone being generated during choking by said musical tone generator, as desired according to a type of scale.

Preferably, the electronic musical instrument according to the first or second aspect of the present invention further comprises a vibrato control device for providing control to apply a vibrato effect to a musical tone being generated by the musical tone generator, according to operation of the effect-application operating element.

Preferably, the electronic musical instrument according to the third or fourth aspect of the present invention further comprises a vibrato control device for providing control to apply a vibrato effect to a musical tone being generated by the musical tone generator, according to operation of the arm.

Preferably, in the electronic musical instrument according to the first or second aspect of the present invention, the effect-application operating element is operatable in a plurality of stages including a first stage, and at least one stage lower than the first stage, and the controller provides control to stop application of a choking effect to a musical tone being generated by the musical tone generator when operation of the effect-application operating element shifts from the first stage or a stage higher than the first stage to a stage lower than the first stage.

Preferably, in the electronic musical instrument according to the third or fourth aspect of the present invention, the arm is operatable in a plurality of stages including a first stage, and at least one stage lower than the first stage, and the controller provides control to stop application of a choking effect to a musical tone being generated by the musical tone generator when operation of the arm shifts from the first stage or a stage higher than the first stage to a stage lower than the first stage.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof.

Figure 1:
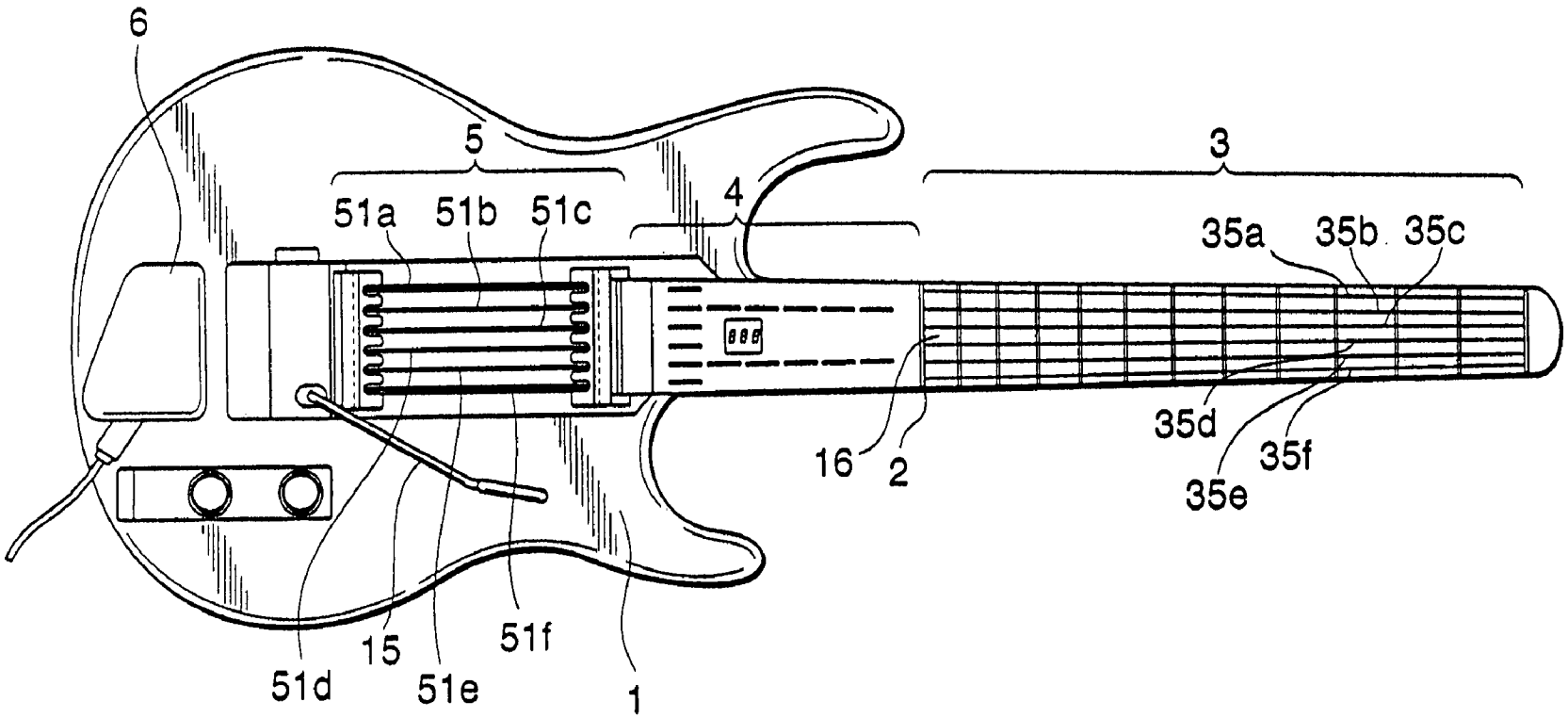
FIG. 1 is a plan view showing an electronic musical instrument according to an embodiment of the present invention.

FIG. 1 is a plan view showing an electronic musical instrument according to an embodiment of the present invention. The electronic musical instrument is configured like a guitar, such that a neck 2 is fixed to a body 1 (musical instrument body; base). The neck 2 is provided with a pitch switch section 3 and a panel operating element 4, while the body 1 is provided with a string input section 5, an arm (an operating element for providing effects) 15, and a memory slot 6. In the case of an ordinary electric guitar, the arm 15 is referred to as a tremolo arm, but in the case of the electronic musical instrument according to the present embodiment, the arm 15 functions as an operating element for providing effects to control multiple functions, and is therefore only referred to as the arm 15. The string input section 5 includes six sounding timing determination operating elements (hereinafter referred to as "stringed operating elements") 51*a* to 51*f* formed of string members. Like strings of a guitar, the stringed operating element 51*a* is the thickest, and the other stringed operating elements 51*b* to 51*f* are reduced in thickness in this order.

In the electronic musical instrument according to the present embodiment, the pitch is set by operating the pitch switch section 3 as in the case where areas between frets of a guitar are touched with the left hand, and the stringed operating elements 51 of the string input section 5 are plucked as in the case where guitar strings are plucked with the right hand, whereby performance and sounding of a guitar can be artificially realized.

As shown in FIG. 1, the neck 2 is provided with a fingerboard 16 which corresponds to a fret mounted surface of a guitar and has a plurality of fret operating elements 35 (hereinafter referred to as "fret operating elements (35*a* to 35*f*)") thereon. The fret operating elements 35 are arranged in parallel and at locations corresponding to areas between frets of a guitar. A plurality of (e.g. twelve) fret operating elements 35 are provided for each stringed operating element 51, and six fret operating elements 35 are arranged in parallel in each area between frets. For example, the fret operating elements 35*a* to 35*f* correspond to the respective stringed operating elements 51*a* to 51*f*.

The panel operating element 4 is provided with a display section and a variety of switches, for inputting musical instrument types, setting operation modes, and displaying various kinds of information. A predetermined memory card can be inserted into the memory slot 6. Fixed contacts, not shown, are provided below the fret operating elements 35 (in a direction toward the inner side of the neck 2), while moving contacts, not shown, are provided in lower parts of the fret operating elements 35. The depression/release of the fret operating elements 35 turns on/off the moving contacts and the fixed contacts, so that the operative status of the fret operating elements 35 can be detected.

The arm 15 is provided in the vicinity of the string input section 5 of the body 1 so that it can be operated in the vicinity of the string input section 5. The arm 15 is disposed at such a location as to be easily operated with the right hand, and is configured to be pushed up and down at a predetermined angle. The arm 15 is pushed up and down to provide a musical tone effect (vibrato) as is the case with an ordinary arm, but in the present embodiment, the arm 15 can also provide a choking effect when pushed up, for example (described later in further detail).

Although not illustrated, the operation of the arm 15 is detected in a plurality of stages (e.g. two stages). Particularly in choking, the first stage in which the arm 15 is pushed up corresponds to a first choking ON event, and the second stage in which the arm 15 is further pushed up corresponds to a second choking ON event. Specifically, in terms of operational angle, the range between a first angle and a second angle corresponds to the first stage, the range equal to or greater than the second angle corresponds to the second stage, and the range between the angle of 0° and the first angle corresponds to no stage (i.e. "play" range). The operation of the arm 15 should not necessarily be detected in two stages, but may be detected in three or more stages or continuously; the arm 15 may be pushed down in stages or continuously.

Figure 2:
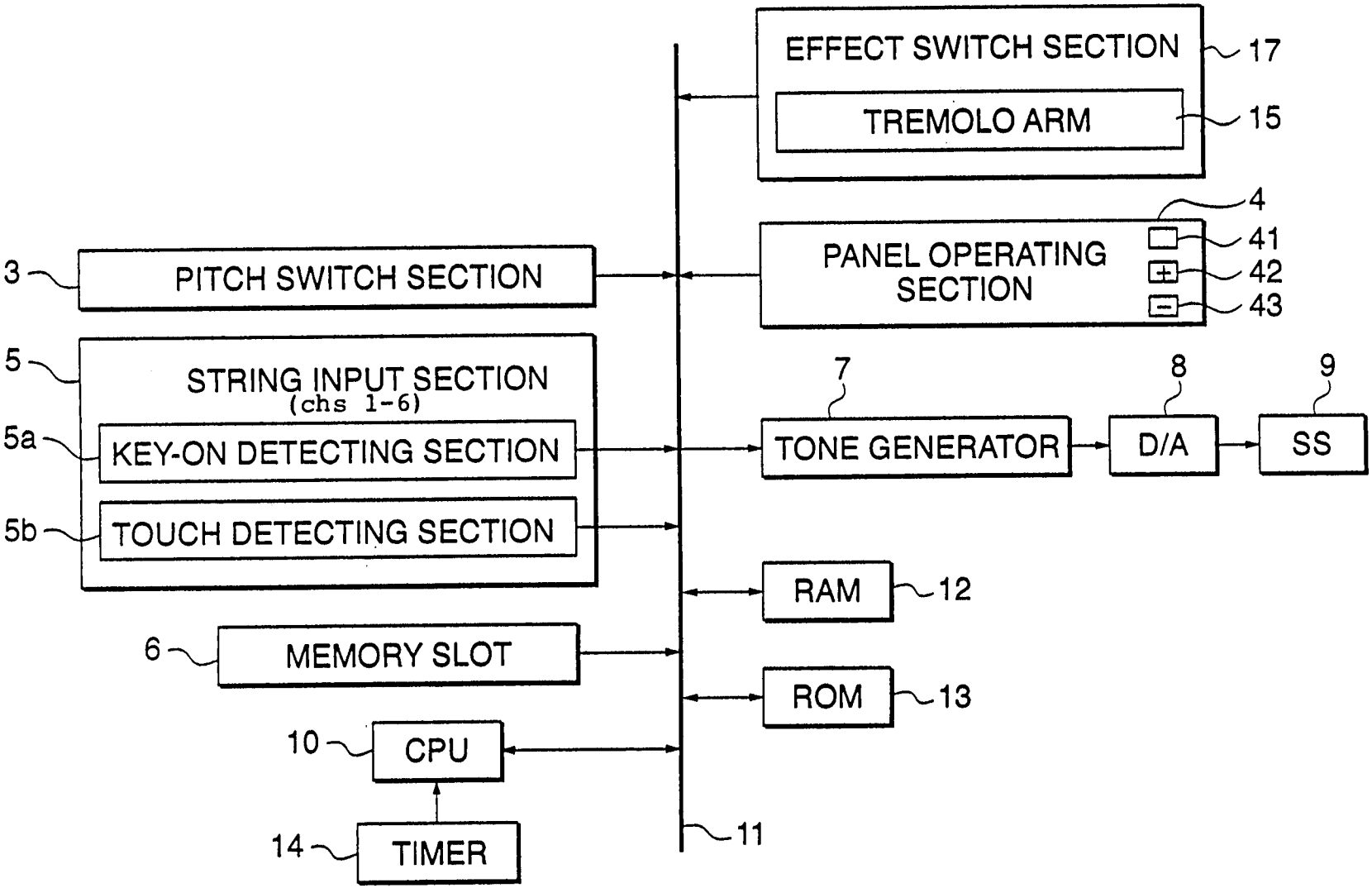
FIG. 2 is a block diagram schematically showing the functional blocks of the electronic musical instrument.

FIG. 2 is a block diagram schematically showing the functional blocks of the electronic musical instrument according to the present embodiment. The electronic musical instrument is constructed such that the pitch switch section 3, the panel operating section 4, the string input section 5, the memory slot section 6, a tone generator (musical tone generator) 7, a RAM 12, a ROM 13, and an effect switch section 17 are connected to a CPU (controller; auto-choking controller) 10 via a bus 11. The output of the tone generator 7 is connected to a sound system (SS) 9 including an amplifier, a speaker, and so forth via a D/A converter 8. The SS 9 converts a musical tone signal output from the D/A converter 8 into an audio signal. A timer 14 is connected to the CPU 10.

The pitch switch section 3 outputs a detection signal corresponding to the depressed fret operating element 35, and supplies the same to the CPU 10. The output detection signal serves as a signal indicative of which has been depressed among the plurality of fret operating elements 35 corresponding to each stringed operating element 51, i.e. a signal which specifies the pitch of musical tones to be generated (hereinafter referred to as the "sounding pitch").

As described later, when two or more fret operating elements 35 corresponding to the same stringed operating element 51 are depressed, the sounding pitch is designated based upon only the fret operating element 35 of a higher pitch. If no fret operating element 35 is depressed, the corresponding stringed operating element 51 is treated as an open string.

The string input section 5 is provided with a key-on detecting section 5*a* and a touch detecting section 5*b*. Although detailed description is omitted, each stringed operating element 51 is provided with a piezoelectricity sensor, not shown, for outputting a signal according to the intensity at which each stringed operating element 51 has been plucked. The output signal from the piezoelectricity sensor specifies whether the stringed operating element 51 has been plucked or not and the intensity at which the stringed operating element 51 has been plucked. The key-on detecting section 5*a* outputs a signal indicative of whether any stringed operating element 51 has been plucked or not, and the touch detecting section 5*b* outputs a signal indicative of the intensity at which any stringed operating element 51 has been plucked. These output signals are supplied to the CPU 10 for each stringed operating element 51. According to an output from the touch detecting section 5*b*, it is also determined whether any stringed operating element 51 has been softly touched with a finger (including a touch with a finger for the purpose of muting and a touch with a finger immediately before plucking), or has been plucked for the purpose of sounding.

The memory slot 6 is for supplying music data such as MIDI data stored in a memory card inserted therein to the CPU 10. The ROM 13 stores control programs to be executed by the CPU 10, various table data, and so forth. The RAM 12 temporarily stores various input information such as performance data and text data, various flags and buffer data, calculation results, and so forth. The timer 14 clocks an interrupt time period during a timer interrupt process and various time periods.

The panel operating section 4 is provided with at least a parameter setting button 41, a "+" button 42, and a "−" button 43. The parameter setting button 41 is used for calling a "parameter to be set". The values of parameters (such as types and items) are conceptually arranged so that they can be circulated (not illustrated), and the value of a parameter to be set, which has been selected using the parameter setting button 41, is increased and decreased using the "+" and "−" buttons 42 and 43 to select a desired value. The effect switch section 17 detects the operative status of the above-mentioned arm 15, and supplies a detection signal indicative thereof to the CPU 10.

According to the present embodiment, six sounding channels (ch) are set, and the stringed operating elements 51*a* to 51*f* correspond to the respective channels (ch1) to (ch6). Either an "automatic performance mode" or a "real-time performance mode" can be set as a performance mode. Further, either an "effect control mode" in which effects can be provided or an "effect-application inhibiting mode" in which effect application is inhibited without exception can be set as the "real-time performance mode". The "effect control mode" includes a "choking mode" and a "vibrato mode".

The CPU 10 sends a tone generation instruction signal to the tone generator 7 according to signals output from the pitch switch section 3, key-on detecting section 5*a*, touch detecting section 5*b*, and memory slot 6. Particularly in the real-time performance mode, a sounding/muting instruction and a key-on velocity are specified according to output signals from the stringed input section 5. In the tone generation instruction signal, the designated sounding pitch PIT(ch) which specifies the sounding pitch in each channel (ch) is specified according to output signals from the pitch switch section 3. Particularly in the effect control mode, the designated sounding pitch PIT(ch) varies with time according to output signals from the effect switch section 17.

A description will now be given of main register values used for various kinds of processing described later.

Figure 3:
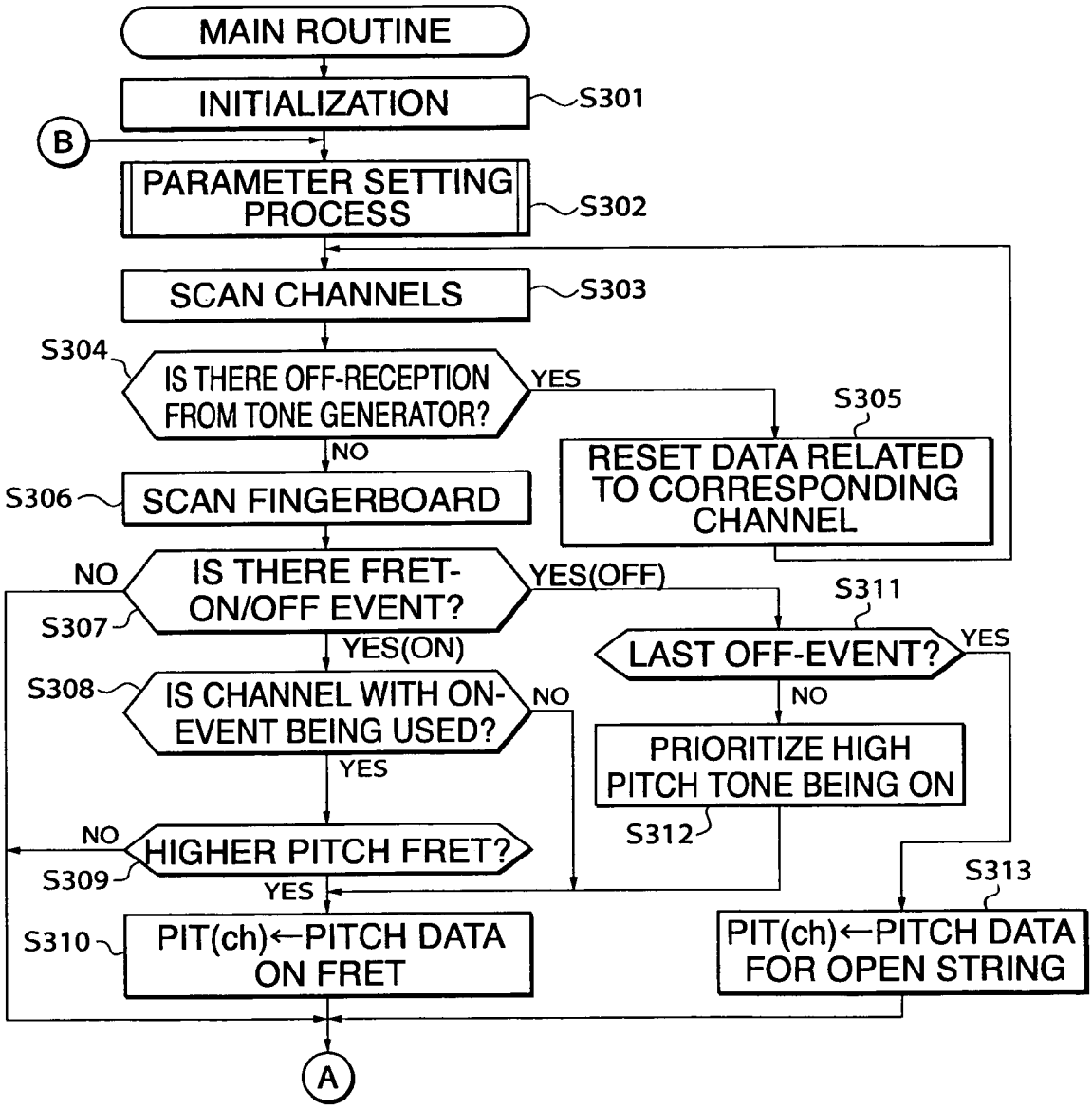
FIG. 3 is a flow chart showing a main routine which is executed in a real-time performance mode.

A register value "designated sounding pitch PIT(ch)" basically specified according to output signals from the pitch switch section 3 for each channel to specify the sounding pitch (steps S310 and S313 in FIG. 3). In the choking mode, however, the "designated sounding pitch PIT(ch)" varies according to a multiplication value PUP, described later, to provide a choking effect (step S610 in FIG. 6B).

Figure 4:
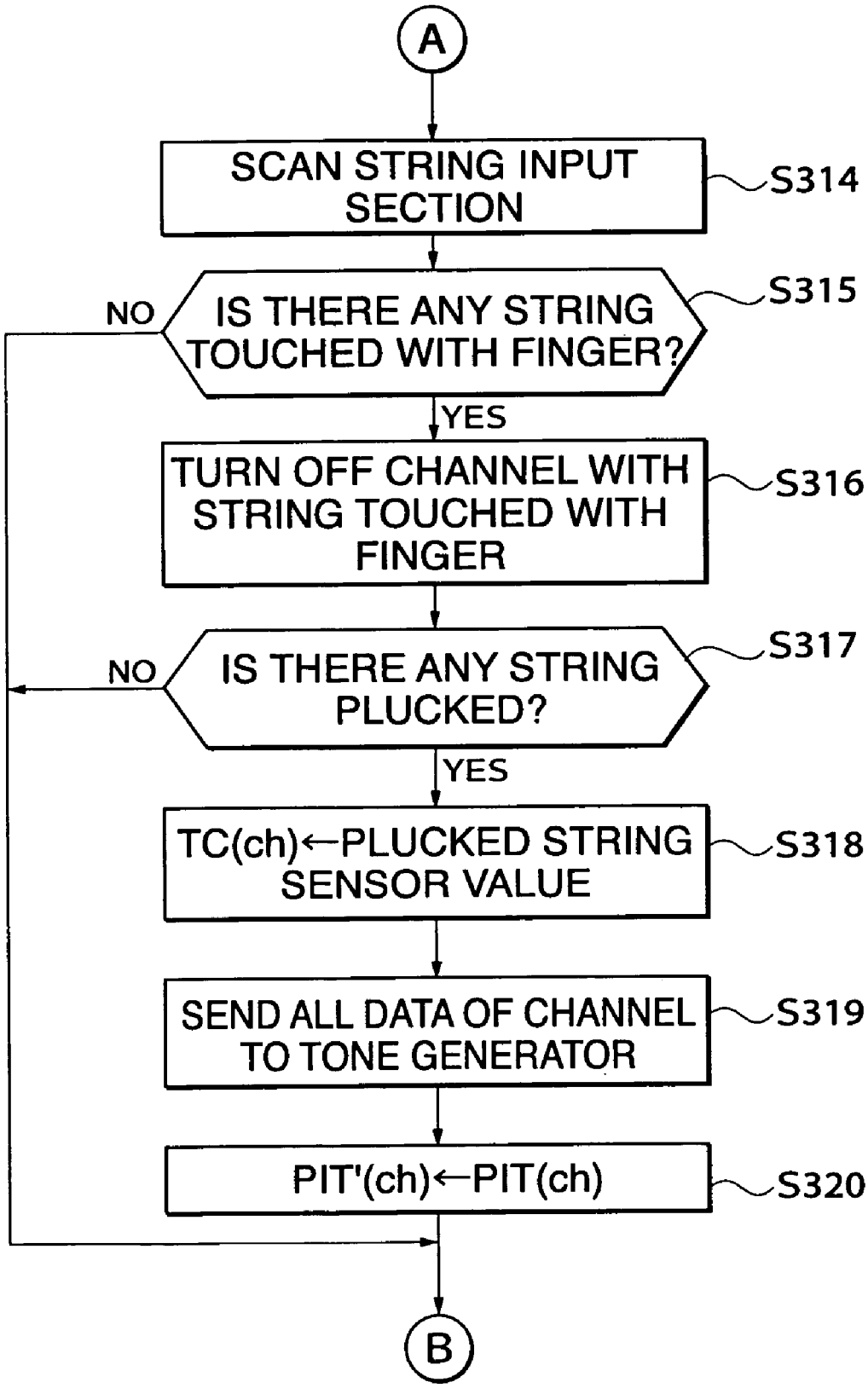
FIG. 4 is a continued part of the flow chart in FIG. 3.

A register value "basic pitch PIT' (ch)" is an initial value of the designated sounding pitch PIT(ch) specified according to output signals from the pitch switch section 3 for each channel (step S320 in FIG. 4). Particularly in the effect control mode, the "basic pitch PIT' (ch)" is used for holding the value of the designated sounding pitch PIT(ch) before application of effects is started.

A register value "touch data TC(ch)" is specified according to output signals from the touch detecting section 5*b* for each channel to specify the velocity of a musical tone (step S318 in FIG. 4).

Figure 5:
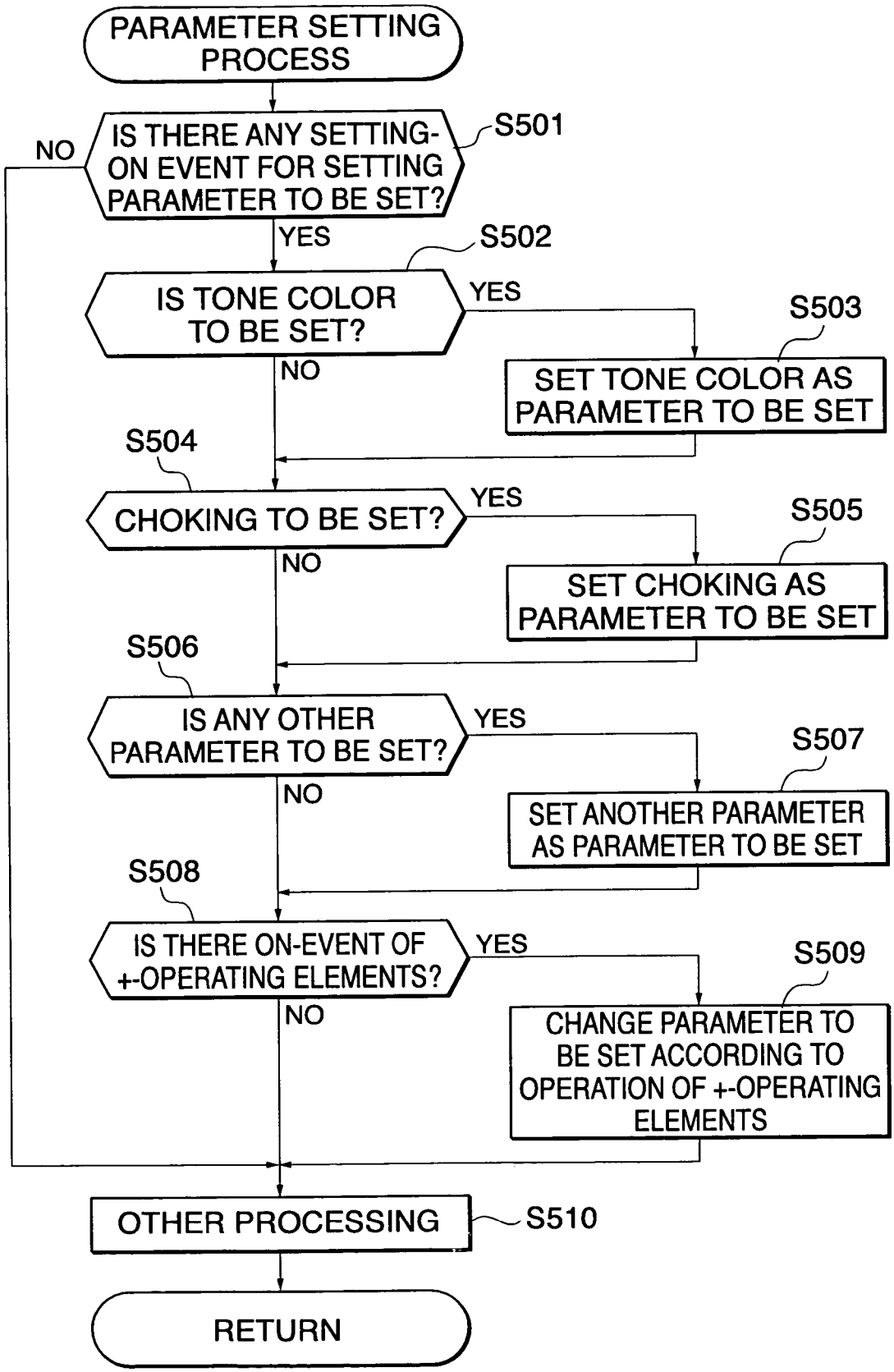
FIG. 5 is a flow chart showing a parameter setting process carried out in a step S302 in FIG. 3.

A register value "multiplication value PUP" is a value by which each designated sounding pitch PIT(ch) is multiplied at each timer interrupt to update the value of each designated sounding pitch PIT(ch) (step S610 in FIG. 6B) to determine the curve of a change in pitch (a variation in pitch including the speed at which choking is achieved) in the choking mode. The multiplication value PUP is set to a predetermined value PUP1 or a predetermined value PUP2 (steps S607 and S608 in FIG. 6B), and is initially set to the predetermined value PUP 1. The predetermined values PUP1 and PUP2 may be changed/set by a parameter setting process (FIG. 5). The predetermined value PUP1 is smaller than the predetermined value PUP2; for example, the predetermined value PUP2 is set to be twice as large as the predetermined value PUP1.

As described later, in the choking mode, the designated sounding pitch PIT(ch) increases to a value "PIT' (ch)×2$^{n}$" and thereafter is held at the fixed value. Therefore, the set value n specifies the depth of choking, and is set to "1/12" or "2/12", for example. If the set value n is "1/12", half-tone (100 percent) choking is performed, and if the set value n is "2/12", whole tone (200 sent) choking is performed.

FIGS. 3 and 4 are flow charts showing a main routine executed in the real-time performance mode according to the present embodiment. This main routine is executed by the CPU 10 after power supply of the electronic musical instrument according to the present embodiment is turned on. FIG. 5 is a flow chart showing the parameter setting process carried out in a step S302 in FIG. 3.

First, in a step S301 in FIG. 3, initialization is carried out, i.e. the execution of a predetermined program is started, and initial values are set in various registers such as the RAM 12. Then, the parameter setting process in FIG. 5 is carried out (step S302).

Specifically, in a step S501 in FIG. 5, it is determined whether a setting-ON event for setting the above-mentioned "parameter to be set" has occurred or not. The setting-ON event occurs in response to depression of the parameter setting button 41 in the panel operating section 4 (refer to FIG. 2). Examples of parameters which can be set using the parameter setting button 41 include at least "tone color" and "choking", but this is not limitative.

If it is determined in the step S501 that the setting-ON event has not occurred, the process proceeds to a step S510. On the other hand, if it is determined in the step S501 that the setting-ON event has occurred, the process proceeds to a step S502 wherein it is determined whether the parameter selected in the setting-ON event is "tone color" or not. If the selected parameter is not "tone color", the process proceeds to a step S504. On the other hand, if the selected parameter is "tone color", "tone color" is set as a parameter to be set (step S503), and the process proceeds to the step S504.

In the step S504, it is determined whether the parameter selected in the setting-ON event is "choking" or not. If the selected parameter is not "choking", the process proceeds to a step S506. On the other hand, if the selected parameter is "choking", "choking" is set as a parameter to be set (step S505), and the process proceeds to the step S506.

In the step S506, it is determined whether or not the parameter selected in the setting-ON event is "another parameter" other than "tone color" and "choking". If the selected parameter is not "another parameter", the process proceeds to a step S508. On the other hand, if the selected parameter is "another parameter", "another parameter" is set as a parameter to be set (step S507), and the process proceeds to the step S508. It should be noted that examples of "another parameter" include "vibrato" and "volume", as well as the above-mentioned predetermined values PUP1 and PUP2.

In the step S508, it is determined whether an ON event of the "+/−" buttons 42, 43 has occurred or not. If the ON event has not occurred, the process proceeds to a step S510. On the other hand, if the ON event has occurred, the value of the set "parameter to be set" is changed according to the operation of the "+/−" buttons 42, 43 (step S509), and the process proceeds to the step S510.

In the step S509, if "choking", for example, is selected as a parameter to be set, the above-mentioned set value n can be set. If "vibrato" is selected as a parameter to be set, a variation in pitch corresponding to the operated amount of the arm 15, a gate time before the start of vibrato in delay vibrato and so forth can be set. What is set should not be limited. For example, if "vibrato" is selected as a parameter to be set, the depth of vibrato can also be set, so that when the arm 15 is operated, the set depth of vibrato can be uniquely applied irrespective of the operated amount of the arm 15.

Then, in the step S510, other processing is carried out; e.g. various settings including setting of a mode from among various modes such as the performance mode and the effect control mode. The settings are held as register values or flags. The parameter setting process is then terminated.

Referring again to FIG. 3, in the next step S303, all the six sounding channels (ch) are scanned, and the process then proceeds to a step S304 wherein it is determined whether there has been OFF reception from the tone generator 7, i.e. whether the level of a musical tone being sounded in each sounding channel has decreased to become equal to or less than a predetermined value. If it is determined in the step S304 that there has been the OFF reception, all the data (e.g. registers and flags) relating to each sounding channel are reset (step S305), and the process returns to the step S303. On the other hand, if there has not been the OFF reception, the process proceeds to a step S306 wherein fingerboard scanning is carried out, i.e. it is detected whether a fret-on/off event has occurred in which any fret operating element 35 has been depressed or released.

Next, it is determined whether the fret-on/off event has occurred or not (step S307). If the fret-on event has occurred, the process proceeds to a step S308. If the fret-off event has occurred, the process proceeds to a step S311. If neither the fret-on event nor the fret-off event has occurred, the process proceeds to a step S314 in FIG. 4.

In the step S308, it is determined whether the channel (ch) in which the fret-on event has occurred is being used or not. Here, if the channel (ch) in which the fret-on event has occurred is being used, this means that any fret operating element 35 other than the currently depressed fret operating element 35 is being depressed among the fret operating elements 35 corresponding to the same stringed operating element 51, which relates to the fret-on event, i.e. a plurality of fret operating elements 35 corresponding to the same stringed operating element 51 are being depressed at the same time.

If it is determined in the step S308 that the channel (ch) in which the fret-on event has occurred is not being used, this means that only one of the fret operating elements 35 corresponding to the same stringed operating elements 51 is currently depressed. Therefore, pitch data specified by the depressed fret operating element 35 is set to the designated sounding pitch PIT(ch) (step S310), and the process then proceeds to the step S314. On the other hand, if the channel (ch) in which the fret-on event has occurred is being used, the currently depressed one of the fret operating elements 35 is the secondly or subsequently depressed one among the fret operating elements 35 corresponding to the same stringed operating element 51, and hence it is then determined whether the currently depressed fret operating element 35 corresponds to a higher tone fret or not (step S309).

Specifically, the previously depressed fret operating element 35 and the currently depressed fret operating element 35 are compared with each other to determine whether or not the currently depressed fret operating element 35 corresponds to a higher tone fret which specifies a higher pitch than the previously depressed fret operating element 35. If it is determined that the currently depressed fret operating element 35 corresponds to a higher tone fret, the process proceeds to the step S310 wherein the pitch data specified by the currently depressed fret operating element 35 is newly set to the designated sounding pitch PIT(ch), and the process then proceeds to the step S314. On the other hand, if it is determined that the currently depressed fret operating element 35 does not correspond to a higher tone fret, the process proceeds to the step S314 without changing the designated sounding pitch PIT(ch).

In the step S311, it is determined whether the current fret-off event is the last fret-off event or not. Specifically, if no fret operating element 35 other than the one which has been currently released is being depressed among the fret operating elements 35 corresponding to the same stringed operating element 51, it is determined that the current fret-off event is the last fret-off event. If it is determined in the step S311 that the current fret-off event is not the last fret-off event, some of the fret operating elements 35 are being still depressed, and hence the fret operating element 35 corresponding to the highest tone is given priority among the depressed fret operating elements 35 (step S312)

Namely, one of the fret operating elements 35 which specifies a higher tone among the fret operating elements 35 being still depressed corresponding to the same stringed operating element 51 designates the pitch data which should be set to the designated sounding pitch (PIT)(ch). Specifically, only when the fret operating element 35 for the highest tone is released among a plurality of fret operating elements 35 being depressed, the pitch data which should be set to the designated sounding pitch PIT(ch) is changed, and when any other fret operating element 35 than the fret operating element 35 for the highest tone is released,. the pitch data which is currently set to the designated sounding pitch PIT(ch) is maintained.

Then, if the process proceeds from the step S312 to the step S310, the pitch data specified as a result of the higher-tone prioritization in the step S312 is set to the designated sounding pitch PIT(ch).

On the other hand, if it is determined that the present fret-off event is the last fret-off event, this means that only one of the fret operating elements 35 corresponding to the same stringed operating element 51, which was depressed, has been released, which means that the stringed operating element 51 is open. Therefore, the pitch data for the open stringed operating element 51 corresponding to the fret-off event is set to the designated sounding pitch PIT(ch) (step S313). The process then proceeds to the step S314.

In the step S314 in FIG. 4, the string input section 5 is scanned, i.e. touching or plucking of the string input section 5 is detected. Then, in a step S315, whether or not. there is any stringed operating element 51 which has been touched with a finger is determined according to output signals from the key-on detecting section 5*a* and the touch detecting section 5*b*. If it is determined in the step S315 that there is no stringed operating element 51 which has been touched with a finger, the process returns to the step S302. On the other hand, if it is determined in the step S315 that there is any stringed operating element 51 which has been touched with a finger, the channel (ch) for the touched stringed operating element 51 is turned off (muted) (step S316), and then whether or not there is any stringed operating element 51 which has been plucked is determined according to output signals from the key-on detecting section 5*a* and the touch detecting section 5*b* (step S317). The turning-off process is carried out by outputting an instruction for rapidly lowering the level of control inputs to the tone generator 7 which carry out musical tone generation according to musical tone envelope data logically (by hardware) or by software.

If it is determined in the step S317 that there is no stringed operating element 51 which has been plucked, the process returns to the step S302. On the other hand, if it is determined in the step S317 that there is any stringed operating element 51 which has been plucked, a value corresponding to the signal indicative of the intensity of plucking output from the touch detecting section 5*b* (plucked string sensor value) is set to the touch data TC(ch) for the corresponding channel (step S318). Then, in a step S319, all the data corresponding to the plucked stringed operating element 51, i.e. the designated sounding pitch PIT(ch), the touch data TC(ch), the multiplication value PUP, various other register values, and so forth are delivered the tone generator 7. Then, the value of the designated sounding pitch PIT(ch) is stored as a basic pitch PIT'(ch) (step S320), and the process then returns to the step S302.

Figure 6A:
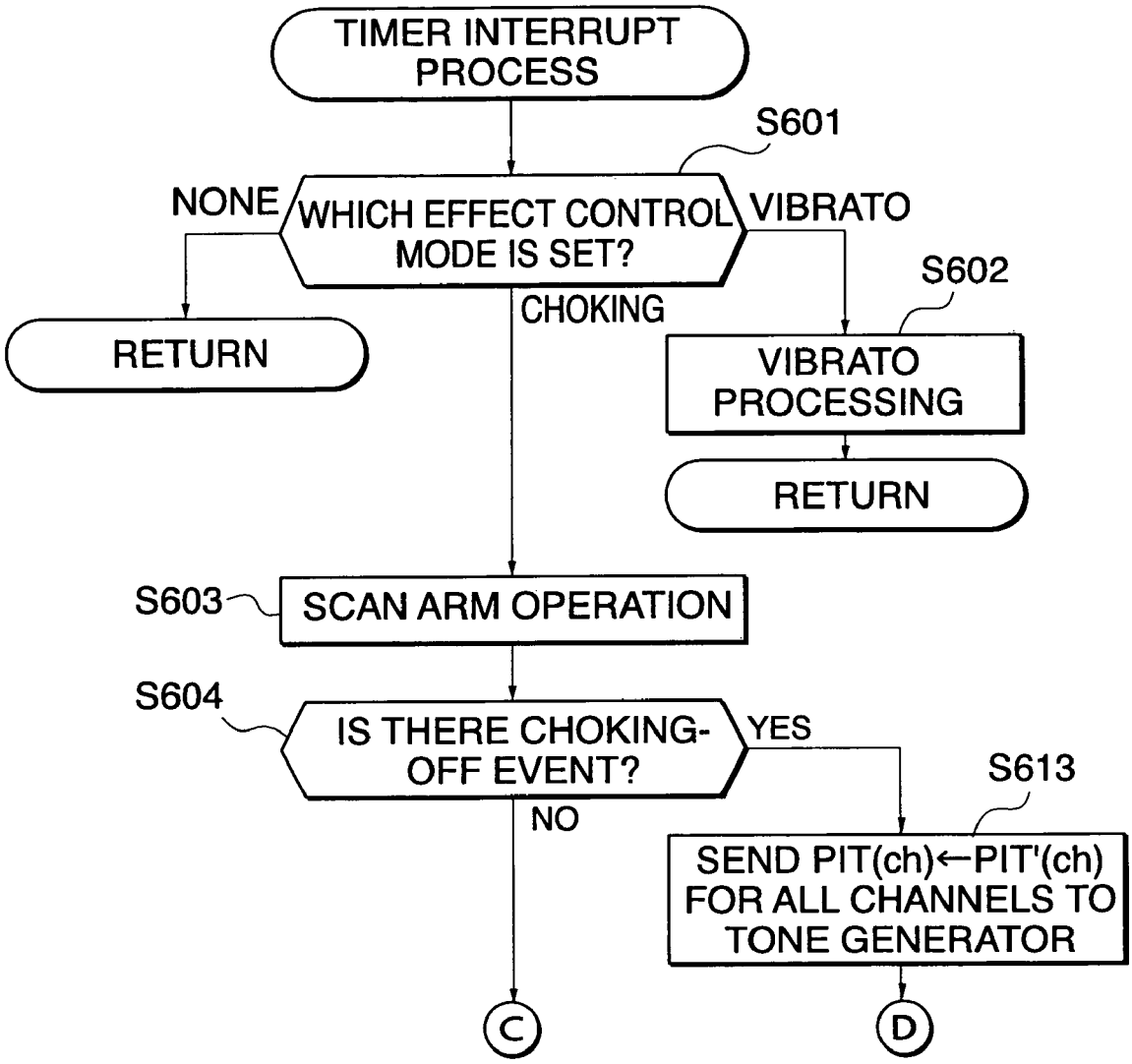
FIGS. 6A and 6B are flow chart showing a timer interrupt process carried out during execution of the main routine in FIGS. 3 and 4.
Figure 6B:
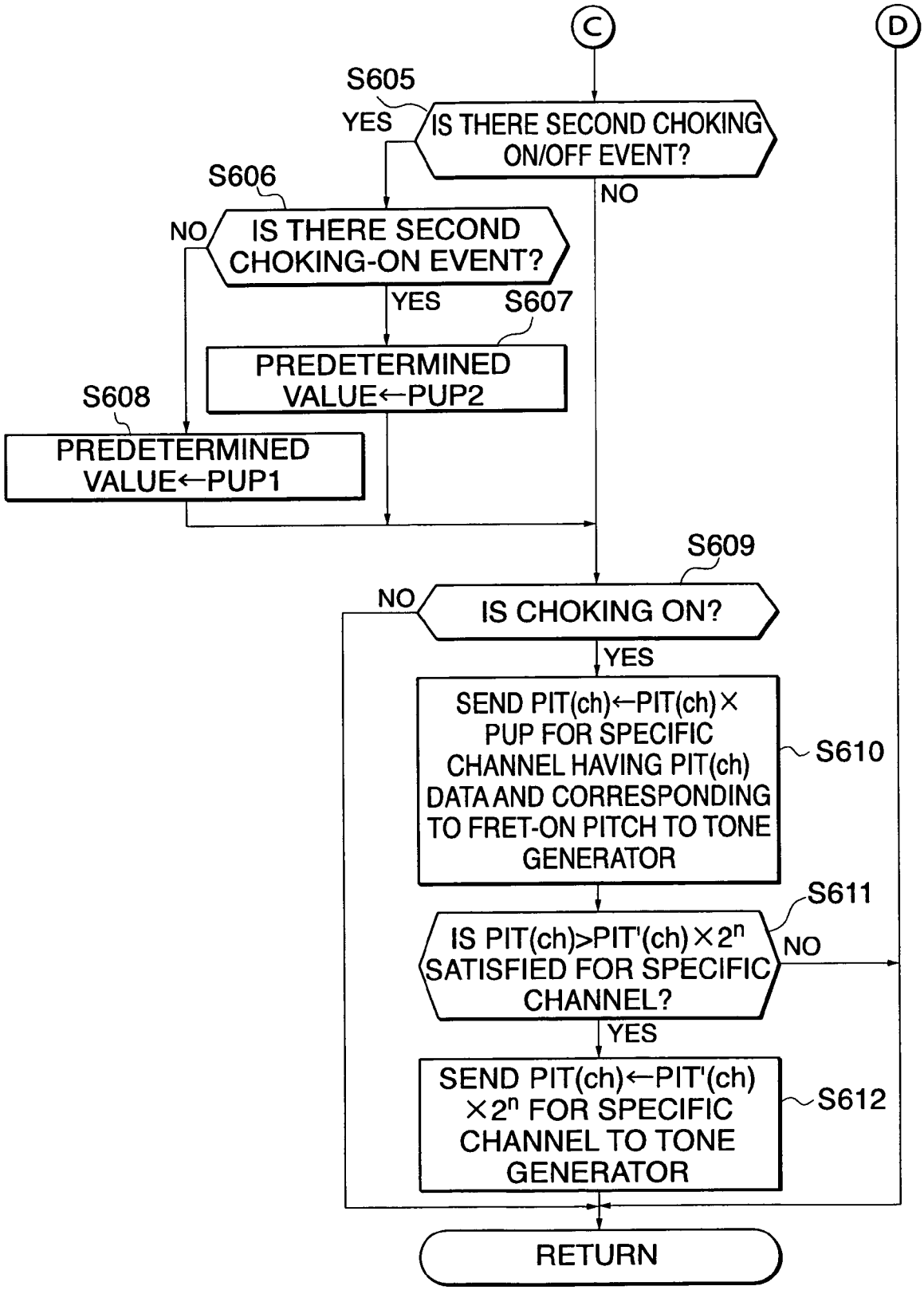

FIGS. 6A and 6B are flow chart showing a timer interrupt process carried out during execution of the main routine in FIGS. 3 and 4. The timer interrupt process is carried out at time intervals of 10 ms, for example.

First, whether the effect control mode has been set or not and whether the set effect control mode is the choking mode or the vibrato mode are determined according to settings of various flags (step S601). If it is determined in the step S601 that the effect control mode has not been set, the process is terminated. If it is determined that the effect control mode has been set and is the vibrato mode, vibrato processing is carried out (step S602), and the process is terminated. In the above "vibrato processing", a vibrato effect application process is carried out according to the operation of the arm 15 by a subroutine, not shown, according to a set value such as a variation in pitch, which is set in the step S509 in FIG. 5.

On the other hand, if it is determined in the step S601 that the effect control mode has been set and is the choking mode, the operation of the arm 15 is scanned, i.e. detected, and whether the operational angle of the arm 15 is in the first or second stage (first or second choking) and whether the operation of the arm 15 corresponds to a choking-on event or a choking-off event are detected (step S603). Then, it is determined whether a choking-off event has occurred or not (step S604). The choking-off event occurs when the operational angle of the arm 15 shifts from the range of the first stage to a lower angle range.

If it is determined in the step S604 that the choking-off event has not occurred, it is determined whether a second choking-ON/OFF event has occurred or not (step S605). If it is determined that the second choking-ON/OFF event has not occurred, it is determined whether choking is ON or not (step S609). If it is determined that choking is not ON, it means that the operational angle of the arm 15 lies in the lower angle range than the range of the first stage, and hence the process is terminated. On the other hand, if it is determined that choking is ON, a choking effect is being applied by the first or second choking, and hence the process proceeds to a step S610.

In the step S610, the designated sounding pitch PIT(ch) is updated by multiplying the sounding pitch PUP (PIT(ch) by the value PUP for the channel which has designated sounding pitch (PIT) (ch) data and corresponds to the fret-on pitch, i.e. the channel for which the pitch has been designated by depression any of the fret operating elements 35 and which is being sounded (hereinafter referred to as the "specified channel"). Then, the updated designated sounding pitch PIT(ch) is delivered to the tone generator 7. As a result, the pitch of a musical tone being sounded in the specific channel increases. If this updating operation continues, the pitch increases toward the target pitch by a predetermined pitch at time intervals of 10 ms. By the way, choking is not applied for the channel for which the fret operating elements 35 are not ON and hence the stringed operating element 51 is open.

Next, whether the designated sounding pitch PIT(ch) is greater than PIT' (ch)×$2^n$ or not is determined for the specific channel (step S611). If it is determined that PIT(ch) is not greater than PIT' (ch)×$2^n$, the target choking depth has not yet been reached, and hence the process is terminated. On the other hand, if it is determined that the designated sounding pitch PIT(ch) is greater than PIT' (ch)×$2^n$, the target choking depth has been reached, and hence the designated sounding pitch PIT(ch) is updated to PIT' (ch)×$2^n$, and the updated designated sounding pitch PIT(ch) is delivered to the tone generator 7 (step S612). As a result, a limitation is imposed on the designated sounding pitch PIT(ch), and after this time point, musical tones having a constant pitch equivalent to PIT' (ch)×$2^n$ are generated. The process is then terminated.

If it is determined in the step S605 that the second choking-ON/OFF event has occurred, it is determined whether this is the second choking-on event or not (step S606). If it is determined that the on/off event is the second choking-on event, this means that the operational angle of the arm 15 has been shifted from the first stage to the second stage, and hence the process proceeds to a step S607 wherein the multiplication value PUP is set to the predetermined value PUP2 (PUP→PUP2), and the process proceeds to the step S609. On the other hand, if it is determined in the step S606 that the on/off event is the second choking-off event, the operational angle of the arm 15 has been shifted from the second stage to the first stage, and hence the process proceeds to a step S608 wherein the multiplication value PUP is set to the predetermined value PUP1 (PUP←PUP1), and the process proceeds to the step S609.

If it is determined in the step S604 that the choking-off event has occurred, the respective designated sounding pitches PIT(ch) are updated to the respective basic pitches PIT' (ch) (PIT(ch)→PIT' (ch)) for all of the six channels (step S613). The updated designated sounding pitches PIT (ch), i.e. the designated sounding pitches PIT(ch) before choking are delivered to the tone generator 7. The process is then terminated.

Figure 7:
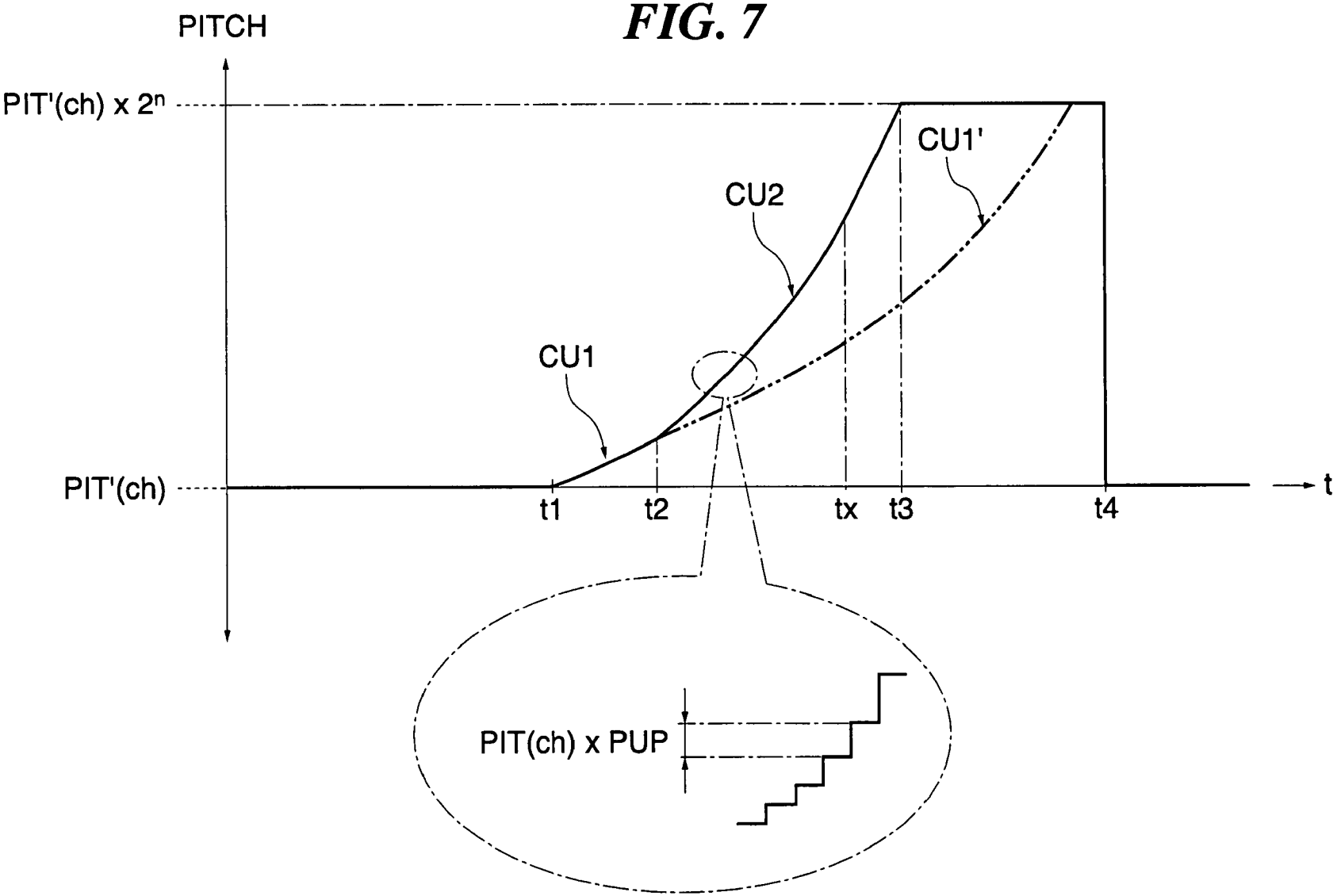
FIG. 7 is a timing chart showing how musical tone effects are controlled in a choking mode.

A description will now be given of an example of the operation of the process in FIGS. 3 to 6B. FIG. 7 is a timing chart showing how musical tone effects are controlled in the choking mode, i.e. how the pitch of a musical tone to be sounded (sounding pitch) varies in a specific channel. The abscissa indicates the elapsed time t, while the ordinate indicates the sounding pitch (frequency). It is assumed that the gate time until the start of choking is "0".

As show in FIG. 7, when the first choking-on event occurs at a time point t1, the designated sounding pitch PIT(ch) is updated by multiplication by the multiplication value PUP (here, the predetermined value PUP1) by the processing in the step S610 whenever the timer interrupt process in FIGS. 6A and 6B is executed, as described above.

For example, the multiplication value PUP is determined such that the target pitch (for example, 200 percent higher than the original pitch (PIT' (ch)) is reached by carrying out the process "PIT(ch)×PUP→PIT(ch)" fifty times, and is set to be slightly greater than "1". Each time the step S610 is executed, the designated sounding pitch PIT(ch) increases with a first curve CU1. If the second choking-on event does not occur any longer, the target pitch is reached with a curve CU1' continuing from the first curve CU1 upon the lapse of (10 ms×fifty times)=0.5 sec after the time t1 as a result of the process carried out fifty times as mentioned above. On the other hand, if the second choking-on event occurs at a time point t2, the designated sounding pitch PIT(ch) is updated by multiplication by the multiplication value PUP (here, the predetermined value PUP2), and the designated sounding pitch PIT(ch) increases with a second curve CU2 which is sharper than the first curve CU1. Thereafter, the present value of the designated sounding pitch PIT(ch) becomes a fixed value after the target pitch "PIT' (ch)×$2^{n''}$" is reached at a time point t3 (step S612 in FIG. 6B).

On this occasion, the value "$2^{n''}$" is e.g. "$\mathbf{2}^{2/12}$" (i.e. n=2/12) if the target value of choking is 200 percent greater than the original value. Here, if the value "n" is set to 1 (i.e. n=12/12) in the steps S505 and S509, the sounding pitch becomes one octave higher than the original pitch upon the lapse of 0.5 seconds if the designated sounding pitch PIT(ch) is increased with the first curve CU1. In this way, if choking-on is performed, the sounding pitch automatically reaches the target pitch, and hence this can be called "auto-choking". Then, if the choking-off event occurs at a time point t4, the designated sounding pitch PIT(ch) becomes a fixed value after returning to the basic pitch PIT' (ch) (step S613 in FIG. 6A).

Further, if the choking-off event occurs while the designated sounding pitch PIT(ch) is increasing (e.g. at a time point tx during choking), the designated sounding pitch PIT(ch) returns to the basic pitch PIT' (ch) at this time point even if the designated sounding pitch PIT(ch) has not reached "PIT' (ch)×2$^{n}$". Therefore, even if choking is normally performed to achieve an increase by about 100 or 200 percent, the target value is set in advance to a relatively large value, e.g. "n=1" which means one octave increase, and according to the state of performance, choking-off is performed when the target pitch is reached while a choking tone is listened to, which enables sophisticated performance.

According to the present. embodiment, if the choking-on event occurs as a result of the operation of the arm 15, the designated sounding pitch PIT(ch) is updated by multiplication by the multiplication value PUP for the "specific channel" which is being sounded other than channels corresponding to open strings, so that the pitch of a musical tone being sounded can be gradually raised. Therefore, the sounding pitch can be controlled to vary for each channel, and therefore, the choking effect can be applied by a simple operation.

Further, the operation of the arm 15 is detected in two stages, i.e. as the first and second choking-on events, and the speed at which the target value is reached in choking (increase curve) is controlled to vary according to the result of detection, so that various choking effects can be applied by simple operations.

Further, the arm 15 can be used not only for choking but also for other effect control (vibrato) by switching the mode, making the electronic musical instrument more simple in construction.

By the way, a variation in pitch during the operation of the arm 15 is caused not only by changing the speed at which the target value in choking is reached, but also by the form of an increase curve or the like. Further, although in the present embodiment, the choking depth is specified by the set value n, this is not limitative, but the choking depth may be varied according to the operation of the arm 15 with the concept of rotational angle or positional control being taken into account. Conversely, the speed at which the target speed is reached in choking may be set by the parameter setting process.

Although in the present embodiment, the six stringed operating elements 51 are used as timing determination operating elements which determine or control sounding timing, it suffices that at least one timing determination operating element is provided insofar as choking effects can be controlled. Further, the stringed operating elements 51 should not necessarily be plucked insofar as they can determine sounding timing. Further, the electronic musical instrument should not necessarily be a guitar type, but the present invention may be applied to other electronic musical instruments insofar as they are each comprised of at least one timing determination operating element corresponding to the stringed operating element 51 and pitch designation operating elements corresponding to a plurality of fret operating elements 35 provided for the timing determination operating element.

Although in the present embodiment, the pitch is controlled to be varied gradually in stages while choking is ON, the pitch may be gradually varied in any other way. Alternatively, the pitch may be controlled to be varied step-functionally.

Further, although in the present embodiment, the choking-off event occurs when the operational angle of the arm 15 shifts from the range of the first or higher stage to a lower range (step S604 in FIG. 6A), the present invention is not limited to this, but the choking-off event may occur when the arm 15 is turned back to cause the operational angle thereof to become lower than a certain threshold, or the choking-off event may occur immediately after the arm 15 is operated in such a direction as to be turned back.

Furthermore, although in the present embodiment, when the parameter to be set is choking, in the step S509 in FIG. 5 the set value n specifying the depth of choking is set according to the operated amount of the arm 15, to thereby set as desired the highest pitch of a musical tone being generated during choking, the highest pitch may be set according to a type of scale as well. The type of scale is not limited to a scale as used in European music. For example, it is possible to set the highest pitch of a musical tone being generated during choking according to an Arabian scale or a scale in Japanese traditional music.

Figure 8:
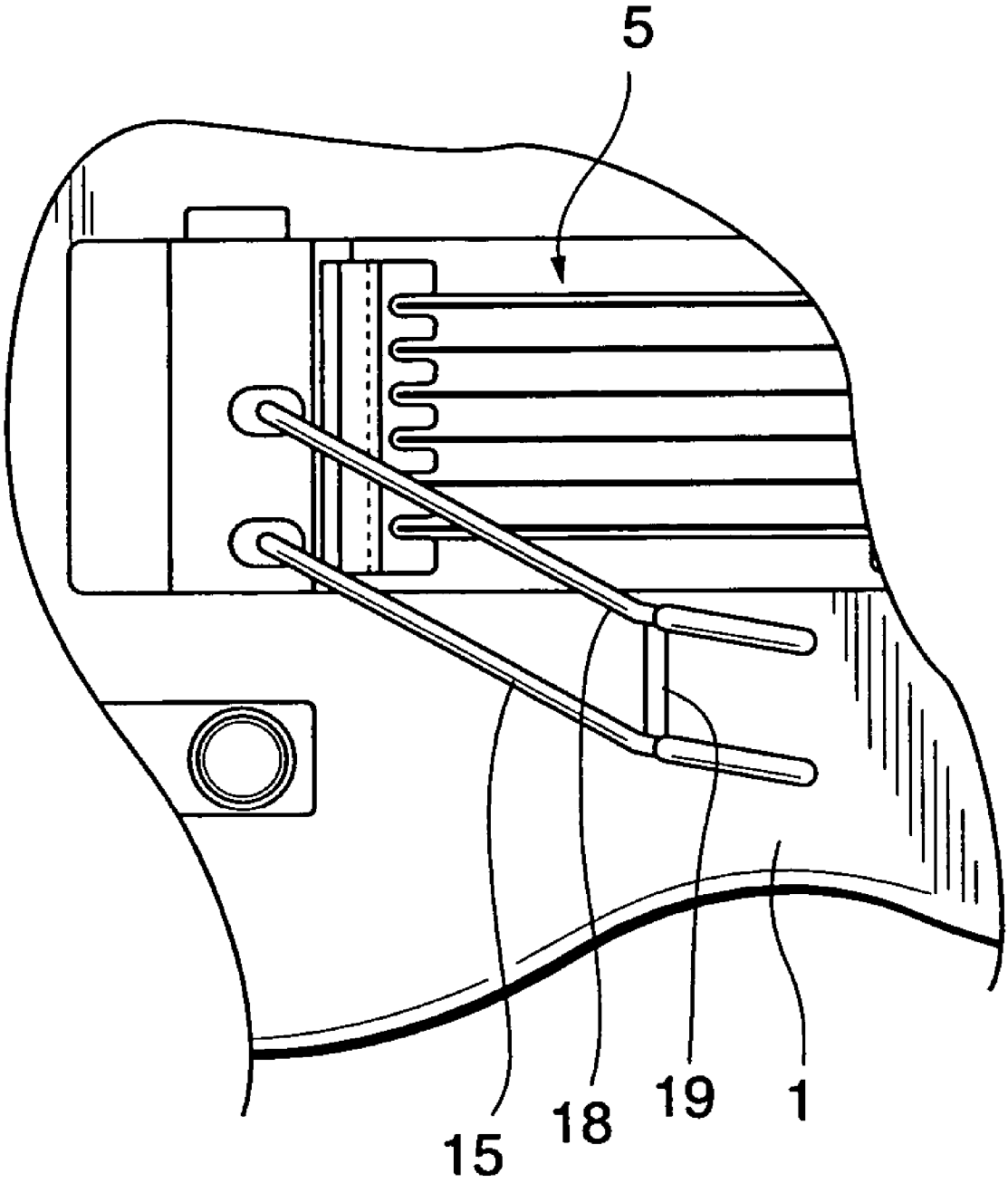
FIG. 8 is a fragmentary plan view showing a variation of the embodiment.

Moreover, although in the present embodiment, the single arm 15 is shared for application of choking and vibrato, this is not limitative, but, for example, as shown in FIG. 8, a plurality of arms may be provided so as to apply effects to musical tones according to respective operations of the arms.

FIG. 8 is a fragmentary plan view showing a variation of the present embodiment. For example, as shown in FIG. 8, an arm 18 is additionally provided in parallel with the arm 15 to serve as a dual arm together with the arm 15. The arm 15 is used to apply choking, and the arm 18 is used to apply vibrato. In this case, the arms 15 and 18 are coupled together by a connection rod 19 in the vicinity of free ends thereof. The two arms 15, 18 are connected to the connecting rod 19 with a play at the connecting parts thereof. When the arms 15, 18 are operated in a direction parallel with or in a direction away from the surface of the body 1, the angles of the arms 15, 19 relative to the connecting rod 19 can vary freely. The two arms 15, 18 can be operated independently of each other, but when either one of the arms is operated in the direction parallel with the surface of the body 1, the other arm is moved in unison via the connecting rod 19. By contrast, when either one of the arms is operated in the direction away from the surface of the body 1, the operated arm alone is moved, while the other arm hardly moves.

The two arms 15, 18 are disposed such that when not operated, they are always held in a neutral position by a spring or the like, not shown. As the arm 15 or the arm 18 is operated in a direction toward the surface of the body 1 or in the direction away from the same, choking or vibrato is applied according to the operating manner of the arm. Thus, a desired one or both of choking and vibrato can be applied in a desired manner.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of the above described embodiment, and hence the program code and a storage medium on which the program code is stored constitute the present invention. Also, if the program code is supplied via a transmission medium or the like, the program code itself constitutes the present invention.

Examples of the storage medium for supplying the program code include a floppy (registered trademark) disk, a hard disk, an optical disk, a magnetic-optical disk, a CD-ROM, a CD-R, a CD-RW, a DVD-ROM, a DVD-RAM, a DVD-R, a DVD-RW, a DVD+RW, an NV-RAM, a magnetic tape, a nonvolatile memory card, and a ROM. Alternatively, the program is supplied by downloading via a network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing the program code read out from the storage medium into a memory provided in an expansion board inserted into a computer or a memory provided in an expansion unit connected to the computer and then causing a CPU or the like provided in the expansion board or the expansion unit to perform a part or all of the actual operations based on instructions of the program code.

What is claimed is:

1. An electronic musical instrument comprising:

a musical instrument body;

a fingerboard fixed to said musical instrument body;

a plurality of pitch designation operating elements provided on said fingerboard in a manner being capable of being depressed, wherein pitch of musical tones to be generated in each of a plurality of sounding channels is designated according to whether at least one corresponding pitch designation operation element of said pitch designation operating elements has been depressed;

a plurality of timing determination operating elements provided on said musical instrument body, for determining sounding timing for respective ones of the sounding channels;

a musical tone generator that generates musical tones according to operation of said pitch designation operating elements and operation of said timing determination operating elements;

an effect-application operating element provided on said musical instrument body in a vicinity of said timing determination operating elements to switch ON/OFF operations for obtaining a choking effect; and a controller responsive to the ON operation of said effect-application operating element, for providing control to obtain the choking effect by raising the pitch of a musical tone being generated by a predetermined amount for a channel among all the sounding channels, for which the pitch has been designated by depression of one of said pitch designation operating elements and in which the musical tone is being generated by said musical tone generator, and responsive to the OFF operation of said effect-application operating element, for providing control to obtain no choking effect.

2. An electronic musical instrument as claimed in claim 1, further comprising a parameter setting operating element for setting a highest pitch of a musical tone being generated during choking by said musical tone generator, as desired according to a type of scale.

3. An electronic musical instrument as claimed in claim 1, further comprising a vibrato control device for providing control to apply a vibrato effect to a musical tone being generated by said musical tone generator, according to operation of said effect-application operating element.

4. An electronic musical instrument as claimed in claim 1, wherein said effect-application operating element is operable in a plurality of stages including a first stage, and at least one stage lower than the first stage, and said controller provides control to stop application of a choking effect to a musical tone being generated by said musical tone generator when operation of said effect-application operating element shifts from the first stage or a stage higher than the first stage to a stage lower than the first stage.

5. An electronic musical instrument as claimed in claim 1, wherein said effect-application operating element is rotatably provided on said musical instrument body, and said controller provides control to obtain the choking effect if said effect-application operating element is pushed up or down at an angle exceeding a predetermined angle, and provides control to obtain no choking effect if said pushed up or down effect-application operating element is returned to an angle which does not exceed the predetermined angle.

6. An electronic musical instrument comprising:

a musical instrument body;

a fingerboard fixed to said musical instrument body;

a plurality of pitch designation operating elements provided on said fingerboard, for determining pitch of musical tones to be generated;

at least one timing determination operating element provided on said musical instrument body, for determining sounding timing;

a musical tone generator that generates musical tones according to operation of said pitch designation operating elements and operation of said timing determination operating element;

an effect-application operating element provided on said musical instrument body in a vicinity of said timing determination operating element to switch ON/OFF operations for obtaining a choking effect; and a controller responsive to the ON operation of said effect-application operating element, for providing control to obtain the choking effect by raising the pitch of a musical tone being generated by said musical tone generator by a predetermined amount, and responsive to the OFF operation of said effect-application operating element, for providing control to obtain no choking effects said controller providing control to vary the pitch of the musical tone during choking according to an operating manner of said effect-application operating element.

7. An electronic musical instrument as claimed in claim 6, wherein said effect-application operating element is operable in a plurality of stages, and said controller is responsive to operation of said effect-application operating element, for providing control to vary the pitch of the musical tone during choking according to a stage, out of the plurality of stages, in which said effect-application operating element is operated.

8. An electronic musical instrument as claimed in claim 6, further comprising a parameter setting operating element for setting a highest pitch of a musical tone being generated during choking by said musical tone generator, as desired according to a type of scale.

9. An electronic musical instrument as claimed in claim 6, further comprising a vibrato control device for providing control to apply a vibrato effect to a musical tone being generated by said musical tone generator, according to operation of said effect-application operating element.

10. An electronic musical instrument as claimed in claim 6, wherein said effect-application operating element is operable in a plurality of stages including a first stage, and at least one stage lower than the first stage, and said controller provides control to stop application of a choking effect to a musical tone being generated by said musical tone generator when operation of said effect-application operating element shifts from the first stage or a stage higher than the first stage to a stage lower than the first stage.

11. An electronic musical instrument as claimed in claim 6, wherein said effect-application operating element is rotatably provided on said musical instrument body, and said controller provides control to obtain the choking effect if said effect-application operating element is pushed up or down at an angle exceeding a predetermined angle, and provides control to obtain no choking effect if said pushed up or down effect-application operating element is returned to an angle which does not exceed the predetermined angle.

12. An electronic musical instrument comprising:

a base;

a fingerboard fixed to said base;

a plurality of pitch designation operating elements provided on said fingerboard, for designating pitch of musical tones to be generated;

at least one timing determination operating element provided on said base, for controlling sounding timing;

a musical tone generator that generates musical tones according to operation of said pitch designation operating elements and operation of said timing determination operating element;

an arm disposed in a vicinity of said timing determination operating element to switch ON/OFF operations for gradually raising the pitch of a musical tone; and an auto-choking controller responsive to the ON operation of said arm, for providing control to gradually raise the pitch of the musical tone being generated by said musical tone generator during operation of said arm after the operation of said arm is started, and responsive to the OFF operation of said arm, for providing no control to gradually raise the pitch of the musical tone.

13. An electronic musical instrument as claimed in claim 12, wherein said arm is operable in a plurality of stages, and said auto-choking controller provides control to raise the pitch of a musical tone being generated by said musical tone generator according to a stage, out of the plurality of stages, in which said arm is operated.

14. An electronic musical instrument as claimed in claim 12, further comprising a parameter setting operating element for setting a highest pitch of a musical tone being generated during choking by said musical tone generator, as desired according to a type of scale.

15. An electronic musical instrument as claimed in claim 12, further comprising a vibrato control device for providing control to apply a vibrato effect to a musical tone being generated by said musical tone generator, according to operation of said arm.

16. An electronic musical instrument as claimed in claim 12, wherein said arm is operable in a plurality of stages including a first stage, and at least one stage lower than the first stage, and said controller provides control to stop application of a choking effect to a musical tone being generated by said musical tone generator when operation of said arm shifts from the first stage or a stage higher than the first stage to a stage lower than the first stage.

17. An electronic musical instrument as claimed in claim 12, wherein said arm is rotatably disposed in the vicinity of said timing determination operating element, and said auto-choking controller provides control to gradually raise the pitch of the musical tone if said arm is pushed up or down at an angle exceeding a predetermined angle, and provides no control to gradually raise the pitch of the musical tone if said pushed up or down arm is returned to an angle which does not exceed the predetermined angle.

18. An electronic musical instrument comprising:

abase;

a fingerboard supported by said base;

a plurality of pitch designation operating elements provided on said fingerboard, for designating pitch of musical tones to be generated;

at least one timing determination operating element provided on said base, for controlling sounding timing;

a musical tone generator that generates musical tones according to operation of said pitch designation operating elements and operation of said timing determination operating element;

an arm disposed in a vicinity of said timing determination operating element in a manner being capable of being operated in a predetermined direction and in a direction opposite to the predetermined direction; and an auto-choking controller operable when said arm is operated in the predetermined direction while said musical tone generator is generating a musical tone, to provide control to issue a choking-on instruction to start a choking function, and to gradually raise the pitch of the musical tone during operation of said arm, said auto-choking controller being operable when said arm is operated in the direction opposite to the predetermined direction during execution of the choking function, to provide control to issue a choking-off instruction to turn off the choking function, and to return the pitch of the musical tone being generated by said musical tone generator to an original pitch designated by said pitch designation operating elements before the choking function is started.

19. An electronic musical instrument as claimed in claim 18, further comprising a parameter setting operating element for setting a highest pitch of a musical tone being generated during choking by said musical tone generator, as desired according to a type of scale.

20. An electronic musical instrument as claimed in claim 18, further comprising a vibrato control device for providing control to apply a vibrato effect to a musical tone being generated by said musical tone generator, according to operation of said arm.

21. An electronic musical instrument as claimed in claim 18, wherein said arm is operable in a plurality of stages including a first stage, and at least one stage lower than the first stage, and said controller provides control to stop application of a choking effect to a musical tone being generated by said musical tone generator when operation of said arm shifts from the first stage or a stage higher than the first stage to a stage lower than the first stage.

* * * * *